US011365862B2

(12) United States Patent
Lee

(10) Patent No.: US 11,365,862 B2
(45) Date of Patent: Jun. 21, 2022

(54) LAMP FOR AUTOMOBILE AND AUTOMOBILE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/318,908

(22) Filed: May 12, 2021

(65) Prior Publication Data

US 2021/0388961 A1 Dec. 16, 2021

(30) Foreign Application Priority Data

Jun. 11, 2020 (KR) ..... 10-2020-0071089

(51) Int. Cl.
*F21S 41/20* (2018.01)
*F21S 41/43* (2018.01)

(52) U.S. Cl.
CPC ..... *F21S 41/285* (2018.01); *F21S 41/43* (2018.01)

(58) Field of Classification Search
CPC ..... F21S 41/285; F21S 41/43; F21S 41/692
See application file for complete search history.

(56) References Cited

U.S. PATENT DOCUMENTS

| | | | | |
|---|---|---|---|---|
| 10,612,741 | B2 * | 4/2020 | Moser | F21S 41/285 |
| 10,746,369 | B2 * | 8/2020 | Gehb | F21S 41/155 |
| 10,746,370 | B2 * | 8/2020 | Han | F21S 41/265 |
| 10,894,506 | B2 * | 1/2021 | Choi | B60Q 3/18 |
| 11,193,643 | B2 * | 12/2021 | Kemetmuller | F21S 41/143 |

* cited by examiner

*Primary Examiner* — Matthew J. Peerce
(74) *Attorney, Agent, or Firm* — DLA Piper LLP (US)

(57) ABSTRACT

A lamp for an automobile and an automobile including the lamp. According to one aspect of the present disclosure, a lamp for an automobile includes: a light source that generates and emits light; and a micro lens array (MLA) module which is provided in front of the light source and on which the light is incident. The MLA module includes: an entrance lens array; an exit lens array; and a shield provided between the entrance lens array and the exit lens array. The shield includes a protrusion area forming an upper periphery of the shield and protruding upward and a recess area recessed downward from the protrusion area. Minute protrusions each having a shape lifted upward are provided in some of the plurality of protrusion areas or the plurality of recess areas.

17 Claims, 7 Drawing Sheets

LAMP FOR AUTOMOBILE AND AUTOMOBILE INCLUDING THE SAME

CROSS-REFERENCE TO RELATED APPLICATION(S)

This application claims priority from and the benefit of Korean Patent Application No. 10-2020-0071089, filed on Jun. 11, 2020, which is hereby incorporated by reference for all purposes as if set forth herein.

TECHNICAL FIELD

Exemplary embodiments relate to a lamp for an automobile and an automobile including the lamp and, more specifically, to a lamp, which is for an automobile and utilizes a micro lens array, and an automobile including the lamp.

BACKGROUND

Micro lens arrays including a plurality of micro lenses are widely used in fields of micro optics such as optical communication and direct optical imaging. Particularly, recent micro lens arrays are capable of forming a specific pattern on a road surface through an optical system having a size of about 10 mm, and thus have been used as a component that performs a welcome light function in an automobile.

However, a diffusion angle of light is as small as about 15 degrees in the micro lens array according to the related art, and thus, lighting functions (for example, a low beam function) other than the welcome light function may not be performed in an automobile. Therefore, there has been a limitation in using the micro lens array in an automobile.

Also, according to the related art, even though beam patterns for an automobile are formed by using the micro lens array, these beam patterns have not satisfied regulations required in beam patterns for an automobile.

SUMMARY

Exemplary embodiments of the present disclosure are to manufacture various types of lamps for an automobile by using a micro lens array, thereby ensuring that beam patterns formed by the lamps satisfy regulations.

A first exemplary embodiment of the present disclosure provides a lamp for an automobile, the lamp including: a light source configured to generate and emit light; and a micro lens array (MLA) module which is provided in front of the light source and on which the light is incident, wherein the MLA module includes: an entrance lens array which includes a plurality of entrance lenses and on which the light is incident; an exit lens array which is provided in front of the entrance lens array and includes a plurality of exit lenses, and which receives the light incident on the entrance lens array and emits the light to the outside, thereby forming a beam pattern on the outside; and a shield provided between the entrance lens array and the exit lens array, wherein the shield includes a plurality of unit shields, each of which includes a protrusion area forming an upper periphery of the shield and protruding upward and a recess area recessed downward from the protrusion area, wherein the plurality of unit shields are arranged in a horizontal direction, and minute protrusions each having a shape lifted upward are provided in some of the plurality of protrusion areas or the plurality of recess areas.

The shield may include a first shield section and a second shield section, wherein the first shield section is provided in a central region of the shield in the horizontal direction, and the second shield section is provided on a left side or a right side of the first shield section, wherein the minute protrusions are provided in the second shield section.

The minute protrusions may be formed in some of the plurality of protrusion areas.

A lower periphery of the shield may have a flat shape.

A ratio of a width of the minute protrusion to a width of the protrusion area including the minute protrusion among the plurality of protrusion areas may be about 0.1 to about 0.3.

The entrance lens array may include a first entrance section and a second entrance section, and the exit lens array may include a first exit section and a second exit section, wherein the first shield section is provided facing the first entrance section and the first exit section, and the second shield section is provided facing the second entrance section and the second exit section.

Each of the plurality of unit shields may be provided corresponding to one of the plurality of exit lenses provided in the exit lens array.

The minute protrusion may be formed in each of the plurality of unit shields provided in the second shield section.

The minute protrusion may not be provided in the first shield section.

At least some of optical axes of the plurality of entrance lenses provided in the first entrance section may be aligned with respective ones of optical axes of the plurality of exit lenses provided in the first exit section, and at least some of optical axes of the plurality of entrance lenses provided in the second entrance section may be misaligned with all of the optical axes of the plurality of exit lenses provided in the second exit section.

Each of all of the optical axes of the plurality of entrance lenses provided in the first entrance section may be aligned with a respective one of the optical axes of the plurality of exit lenses provided in the first exit section, and all of the optical axes of the plurality of entrance lenses provided in the second entrance section may be misaligned with all of the optical axes of the plurality of exit lenses provided in the second exit section.

All of the optical axes of the plurality of entrance lenses provided in the second entrance section may be misaligned, in the horizontal direction, with all of the optical axes of the plurality of exit lenses provided in the second exit section.

All of the optical axes of the plurality of entrance lenses provided in the entrance lens array may be disposed at the same heights in a vertical direction as the respective ones of the optical axes of the plurality of exit lenses provided in the exit lens array.

Widths of the plurality of entrance lenses in a vertical direction, which are provided in the entrance lens array, may be equal to each other.

Widths of the plurality of exit lenses in a vertical direction, which are provided in the exit lens array, may be equal to each other.

A width of each of the plurality of entrance lenses in the horizontal direction, which are provided in the first entrance section, may be equal to a width of each of the plurality of entrance lenses in the horizontal direction, which are provided in the second entrance section.

A width of each of the plurality of exit lenses in the horizontal direction, which are provided in the second exit section, may be less than a width of each of the plurality of exit lenses in the horizontal direction, which are provided in the first exit section.

A second exemplary embodiment of the present disclosure provides an automobile including a lamp for an automobile, wherein the lamp includes: a light source configured to generate and emit light; and a micro lens array (MLA) module which is provided in front of the light source and on which the light is incident, wherein the MLA module includes: an entrance lens array which includes a plurality of entrance lenses and on which the light is incident; an exit lens array which is provided in front of the entrance lens array and includes a plurality of exit lenses, and which receives the light incident on the entrance lens array and emits the light to the outside, thereby forming a beam pattern on the outside; and a shield provided between the entrance lens array and the exit lens array, wherein the shield includes a plurality of unit shields, each of which includes a protrusion area protruding upward from an upper periphery of the shield and a recess area recessed downward from the protrusion area, wherein the plurality of unit shields are arranged in a horizontal direction, and minute protrusion each having a shape lifted upward is provided in some of the plurality of protrusion areas or the plurality of recess areas.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for an automobile, and an automobile according to the present disclosure will be described with reference to the drawings.

Lamp for Automobile

Figure 1:
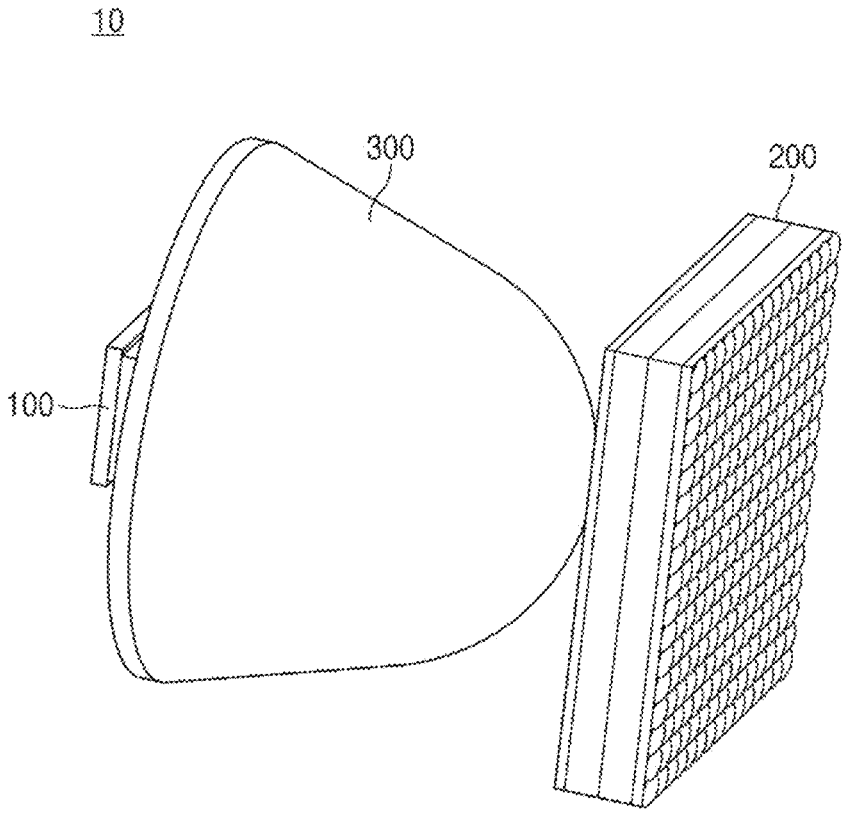
FIG. 1 is a perspective view illustrating a structure of a lamp for an automobile according to the present disclosure.
Figure 2:
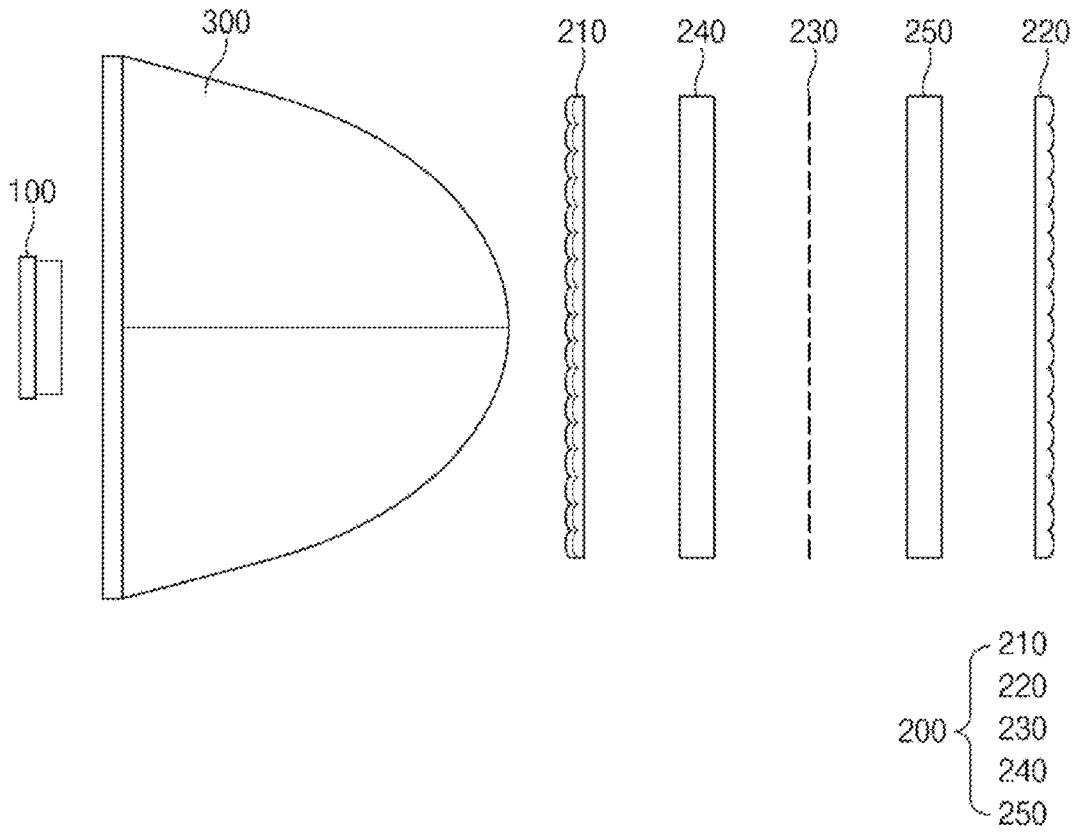
FIG. 2 is a side cross-sectional view illustrating a structure of a lamp for an automobile when an MLA module is disassembled.
Figure 3:
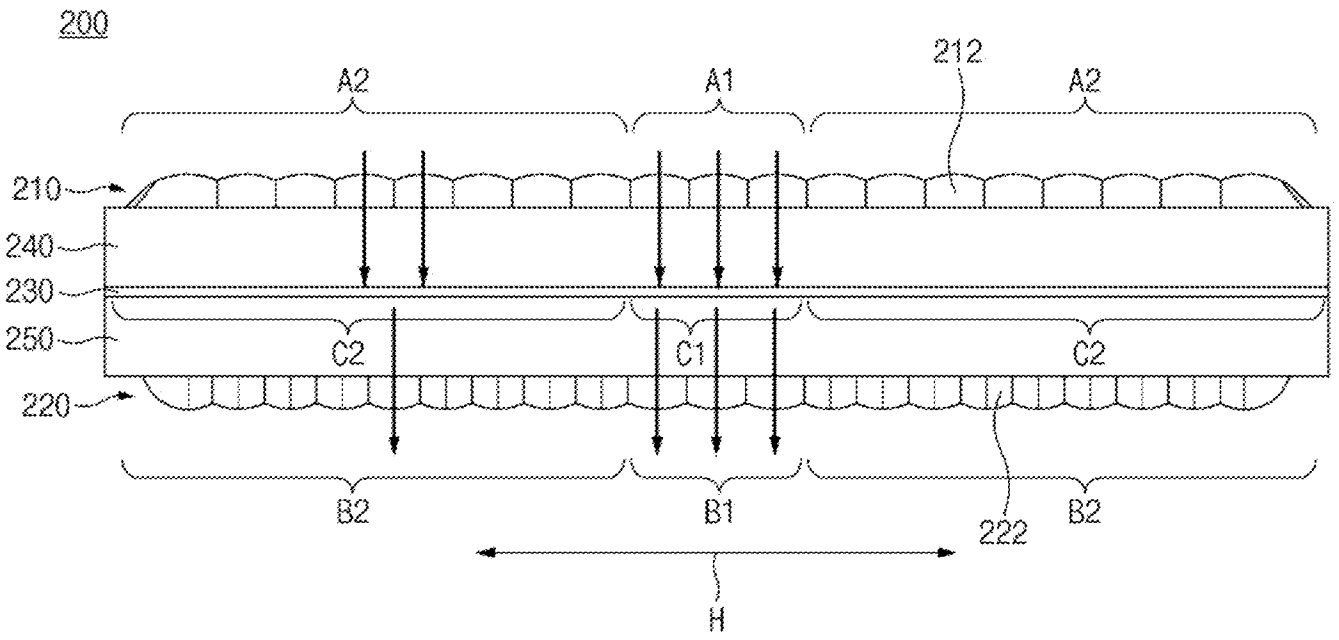
FIG. 3 is a cross-sectional view illustrating a horizontal cross-section of an MLA module of a lamp for an automobile according to the present disclosure.

FIG. 1 is a perspective view illustrating a structure of a lamp for an automobile according to the present disclosure, and FIG. 2 is a side cross-sectional view illustrating a structure of a lamp for an automobile when an MLA module is disassembled. FIG. 3 is a cross-sectional view illustrating a horizontal cross-section of an MLA module of a lamp for an automobile according to the present disclosure, and FIG. 4 is a cross-sectional view illustrating a vertical cross-section of an MLA module of a lamp for an automobile according to the present disclosure.

As illustrated in FIGS. 1 and 2, a lamp 10 for an automobile (hereinafter, referred to as a 'lamp') according to the present disclosure may include: a light source 100 which generates and emits light; and a micro lens array (MLA) module 200 which is provided in front of the light source 100 and includes a plurality of micro lenses and on which the light is incident from the light source 100. The light source 100 may be a light-emitting diode (LED), but is not limited thereto.

Also, the lamp 10 may further include a collimator 300 provided between the light source 100 and the MLA module 200. The collimator 300 may be configured to make light, incident from the light source 100, parallel and then emit the parallel light to the MLA module 200.

Figure 4:
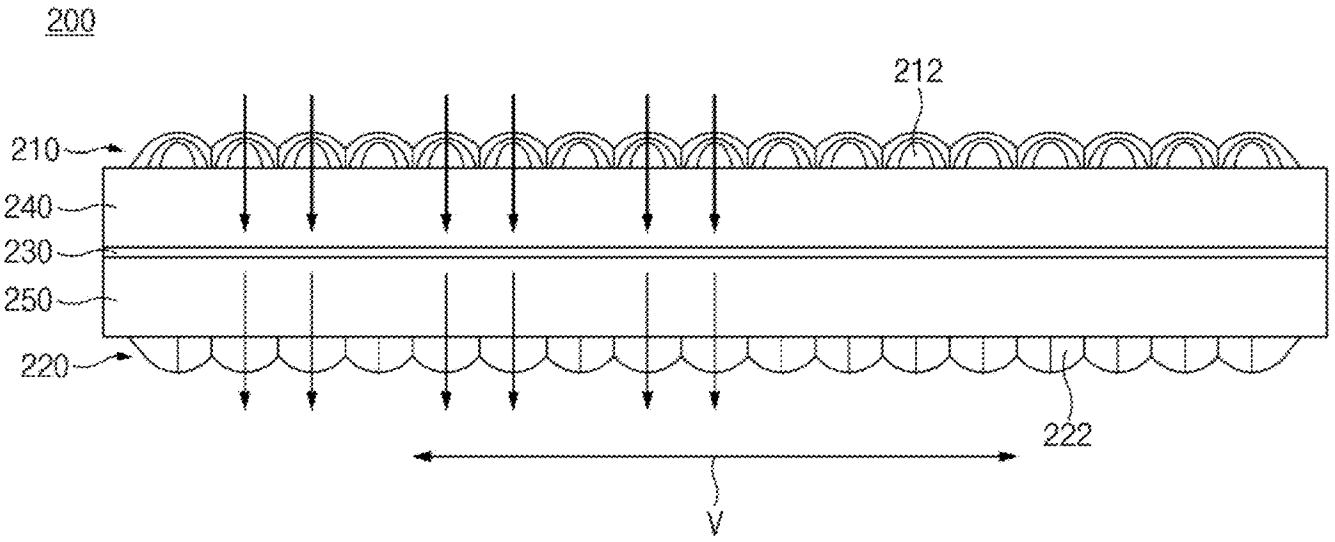
FIG. 4 is a cross-sectional view illustrating a vertical cross-section of an MLA module of a lamp for an automobile according to the present disclosure.

Continuing to refer to FIGS. 2 to 4, the MLA module 200 may include an entrance lens array 210 which is provided facing the collimator 300 and on which the light from the light source 100 is incident. As illustrated in FIGS. 3 and 4, the entrance lens array 210 may include a plurality of entrance lenses 212. Also, referring to FIGS. 2 to 4, the plurality of entrance lenses 212 may be convex lenses convexly protruding toward the light source 100.

Also, referring to FIGS. 2 to 4, the MLA module 200 may include an exit lens array 220 which is provided in front of the entrance lens array 210, receives the light incident on the entrance lens array 210, and emits the light to the outside. As illustrated in FIGS. 3 and 4, the exit lens array 220 may include a plurality of exit lenses 222. Here, as illustrated in FIGS. 2 to 4, the plurality of exit lenses 222 may be convex lenses that convexly protrude outward in a direction opposite to the light source 100.

Here, as illustrated in FIGS. 1 and 2, the MLA module 200 may include a shield 230 provided between the entrance lens array 210 and the exit lens array 220. As illustrated in FIG. 2, the shield 230 may have a plurality of slits through which the light emitted from the entrance lens array 210 may be incident on the exit lens array 220.

Here, in the lamp 10 according to the present disclosure, the shield 230 may be provided at positions corresponding to focuses of the exit lenses 222 provided in the exit lens array 220. In this case, taking into consideration characteristics of the lens, the light, which arrives at the exit lens array 220 after passing through the slits of the shield 230 from the entrance lens array 210, may be emitted to the outside in the form of light parallel to the ground in the vertical direction.

Here, the fact that the shield 230 is provided at the positions corresponding to the focuses of the exit lenses 222 may be interpreted as having not only a case in which the shield 230 and the focuses of the exit lenses 222 overlap each other but also a case in which the shield 230 and the exit lenses 222 are disposed so close to each other. In the latter case, it is understood, by one of ordinary skill in the art to which this disclosure belongs, that there is no substantial difference in functions and effects when compared to the case in which the shield 230 and the exit lenses 222 overlap each other. However, more preferably, the focuses of the exit lenses 222 may be provided within a body of the shield 230.

Here, the MLA module 200 may further include: an entrance body 240 which is provided between the entrance lens array 210 and the shield 230 and supports the entrance lens array 210; and an exit body 250 which is provided between the exit lens array 220 and the shield 230 and supports the exit lens array 220. However, unlike the above configuration, the MLA module 200 may not include the entrance body 240 or the exit body 250.

Here, the lamp 10 according to the present disclosure may be configured to form a low beam pattern of an automobile.

Here, in the lamp 10 according to the present disclosure, the entrance lens array 210 and the exit lens array 220 may be divided into a plurality of sections according to characteristics of the entrance lenses and the exit lenses, respectively.

Referring to FIG. 3, the entrance lens array 210 may be divided into a first entrance section A1 and a second entrance section A2 according to characteristics of the entrance lenses 212 provided in the entrance lens array 210, and the exit lens array 220 may be divided into a first exit section B1 and a second exit section B2 according to characteristics of the exit lenses 222 provided in the exit lens array 220.

Here, the first entrance section A1 may be provided on a central area of the entrance lens array 210 in a horizontal direction H, and the second entrance section A2 may be provided on a left side or a right side of the first entrance section A1. In FIG. 3, second entrance sections A2 are illustrated as being provided on both the left side and the right side of the first entrance section A1.

Here, FIG. 3 illustrates a case in which the first entrance section A1 and the second entrance section A2 are in contact with each other, but unlike the above case, the first entrance section A1 and the second entrance section A2 may be spaced apart from each other. For example, a third entrance section including a plurality of entrance lenses may be provided between the first entrance section A1 and the second entrance section A2.

Here, the first exit section B1 may be provided on a central area of the exit lens array 220 in the horizontal direction H, and the second exit section B2 may be provided on a left area or a right area of the exit lens array 220. In FIG. 3, second exit sections B2 are illustrated as being provided on both the left side and the right side of the first exit section B1.

Here, FIG. 3 illustrates a case in which the first exit section B1 and the second exit section B2 are in contact with each other, but unlike the above case, the first exit section B1 and the second exit section B2 may be spaced apart from each other. For example, a third exit section including a plurality of exit lenses may be provided between the first exit section B1 and the second exit section B2.

Similar to the entrance lens array 210 and the exit lens array 220, the shield 230 may be divided into a plurality of sections. For example, the shield 230 may include a first shield section C1 and a second shield section C2. Here, the first shield section C1 may be provided on a central area of the shield 230 in the horizontal direction H, and the second shield section C2 may be provided on a left side or a right side of the first shield section C1. In FIG. 3, second shield sections C2 are illustrated as being provided on both the left side and the right side of the first shield section C1.

Here, referring to FIG. 3, the first entrance section A1 and the first exit section B1 may face each other with the first shield section C1 therebetween, and the second entrance section A2 and the second exit section B2 may face each other with the second shield section C2 therebetween. Also, the first shield section C1 may face the first entrance section A1 and the first exit section B1, and the second shield section C2 may face the second entrance section A2 and the second exit section B2. More preferably, the first entrance section A1, the first exit section B1, and the first shield section C1 may have the same width in the horizontal direction H, and the second entrance section A2, the second exit section B2, and the second shield section C2 may have the same width in the horizontal direction H.

Thus, according to the present disclosure, the light, which has been emitted from the light source 100 and incident on the first entrance section A1, may be emitted from the first entrance section A1 and then incident on the first exit section B1 after passing through the first shield section C1. Also, the light, which has been emitted from the light source 100 and incident on the second entrance section A2, may be emitted from the second entrance section A2 and then incident on the second exit section B2 after passing through the second shield section C2.

More preferably, the light, which is emitted to the outside after passing through the first entrance section A1, the first shield section C1, and the first exit section B1, may provide a central region of a beam pattern formed outside by the lamp 10 according to the present disclosure. Also, the light, which is emitted to the outside after passing through the second entrance section A2, the second shield section C2, and the second exit section B2, may provide a peripheral region of the beam pattern formed outside by the lamp 10 according to the present disclosure.

Figure 5:
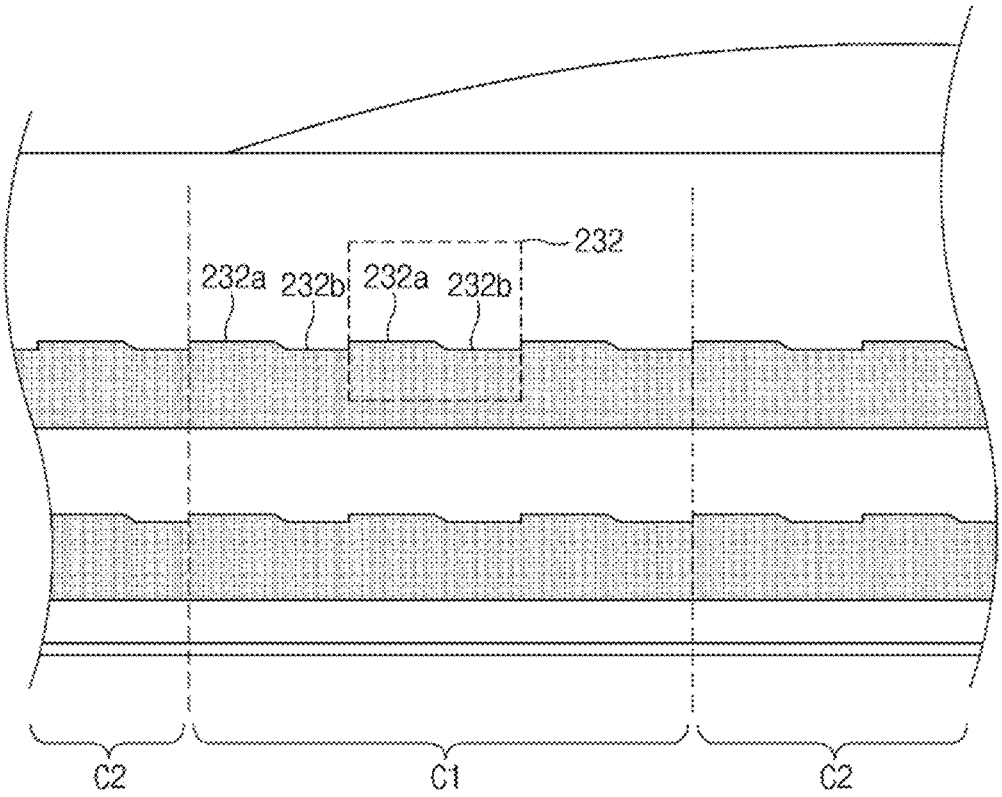
FIG. 5 is a front view illustrating a structure of a shield of a lamp for an automobile according to the present disclosure.
Figure 6:
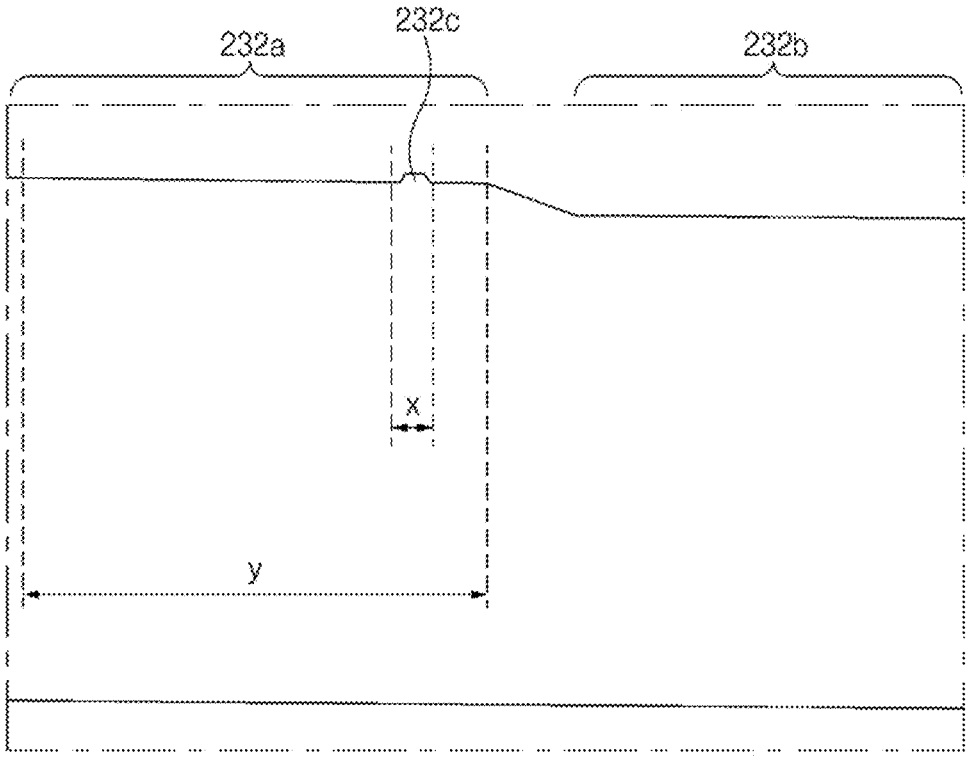
FIG. 6 is an enlarged front view illustrating a minute protrusion formed in a shield of a lamp for an automobile according to the present disclosure.

FIG. 5 is a front view illustrating a structure of a shield of a lamp for an automobile according to the present disclosure, and FIG. 6 is an enlarged front view illustrating a minute protrusion formed in a shield of a lamp for an automobile according to the present disclosure.

Here, as illustrated in FIG. 5, the shield 230 may have a structure in which a plurality of unit shields 232 are arranged in the horizontal direction. Here, the shield 230 may have a structure in which the plurality of unit shields 232 are individually manufactured and then arranged in the horizontal direction. Alternatively, unlike the above-described structure, the shield 230 may have a structure in which the plurality of unit shields 232 are integrally connected. For example, the shield 230 may be manufactured by coating a surface of a body portion constituting a body of the shield 230 with chromium.

Each of the plurality of unit shields 232 constituting the shield 230 may correspond to one of the plurality of exit lenses 222 provided in the exit lens array 220. More preferably, a width of one of the plurality of unit shields 232 may be equal to a width of the exit lens 222 corresponding to the one unit shield 232.

The shield 230 may include a plurality of protrusion areas 232*a* forming an upper periphery of the shield 230 and protruding upward and a plurality of recess areas 232*b* recessed downward from the protrusion areas 232*a*. Also, the protrusion areas 232*a* and the recess areas 232*b* may be alternately arranged in the horizontal direction of the shield 230. Thus, stepped portion may be formed between the protrusion areas 232*a* and the recess areas 232*b*. FIG. 5 illustrates a state in which stepped portions having an inclined shape are formed between the protrusion areas 232*a* and the recess areas 232*b*.

Here, one protrusion area 232*a* and one recess area 232*a* provided on one side of the protrusion area 232*a* may be formed in each of the unit shields 232. Referring to FIG. 5, the protrusion area 232*a* may be provided on the left area of the unit shield 232, and the recess area 232*b* may be provided on the right area of the unit shield 232.

Also, referring to FIG. 6, in the shield 230 of the lamp 10 according to the present disclosure, minute protrusions 232*c* each having a shape lifted upward may be further provided in some of the plurality of protrusion areas 232*a* and the plurality of recess areas 232*b*.

Figure 7:
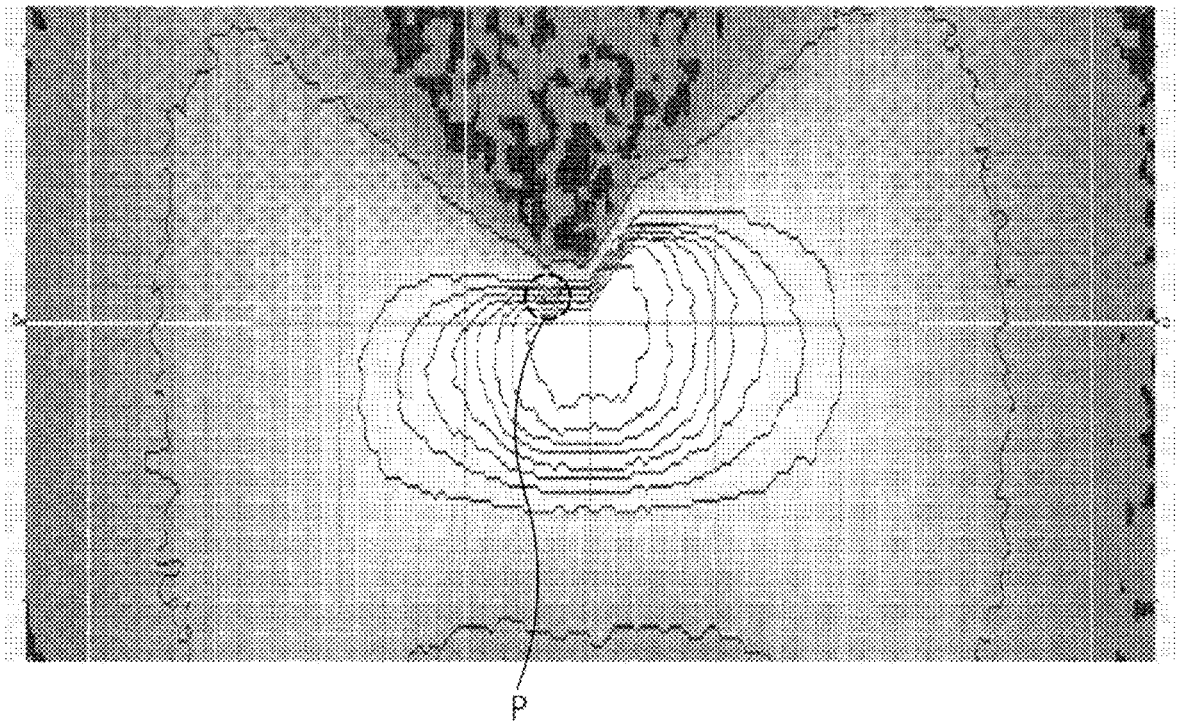
FIG. 7 is a view showing a low beam pattern formed according to the related art.

The shield 230 may be configured to block a portion of light arriving at the shield 230 after passing through the entrance lens array 210, thereby determining a shape of a beam pattern formed by the lamp 10. In particular, as described above, the lamp 10 according to the present disclosure may be configured to form a low beam pattern. In this case, among the light arriving at the shield 230 after passing through the entrance lens array 210, the light arriving at the unit shields 232 is blocked, and the light arriving at the slits formed in the shield 230 arrives at the outside after passing through the shield 230 and forms a low beam pattern. One example of a low beam pattern formed according to the related art is illustrated in FIG. 7. More preferably, the light arriving at the slits formed in the shield 230 may arrive at the outside in a vertically inverted state and form the low beam pattern.

Here, a low beam pattern formed by a lamp for an automobile is required to satisfy various types of regulations so that the low beam pattern prevents a driver of another automobile or a pedestrian from being dazzled while securing the driver's view clearly. For example, as illustrated in FIG. 7, the upper limit of brightness at a 50L area (P) in a low beam pattern is regulated by regulations so as to prevent dazzle of a driver of an oncoming automobile in the opposite lane.

The minute protrusions 232*c* according to the present disclosure are configured to satisfy the regulations that limit the brightness at the 50L area (P). That is, the minute protrusions 232*c* may be formed at positions corresponding to the 50L area (P) of the low beam pattern formed by the lamp 10 according to the present disclosure. The brightness at the 50L area (P) may be reduced by an amount corresponding to the amount of light blocked by the minute protrusions 232*c*, and thus, the regulations for the low beam pattern may be satisfied.

A method for blocking a large amount of light by increasing the height of the shield 230 may be considered to satisfy the regulations for the upper limit of the brightness at the 50L area (P). However, this method is undesirable because the brightness of the beam pattern is excessively reduced. However, when the minute protrusions 232*c* according to the present disclosure are applied, the regulations for the upper limit of the brightness of the beam pattern at the 50L area (P) may be satisfied without affecting the overall brightness of the beam pattern.

Referring to FIGS. 5 and 6 again, each of the minute protrusions 232*c* may be formed in the protrusion area 232*a* in the shield 230. More preferably, the minute protrusions 232*c* may be formed in some of the plurality of protrusion areas 232*a*. The minute protrusion 232*c* is formed in the protrusion area 232*a* not in the recess area 232*b* because the light passing through the shield 230 arrives at the outside in a vertically inverted state.

Also, the minute protrusion 232*c* may be provided in the second shield section C2. As described above, the light, which is emitted to the outside after passing through the first entrance section A1, the first shield section C1, and the first exit section B1, may form the central region of the beam pattern formed outside by the lamp 10 according to the present disclosure, and thus, when the minute protrusions 232*c* are provided in the first shield section C1, the brightness of the beam pattern may be excessively reduced. In order to prevent the reduction in brightness, the minute protrusions 232*c* may be provided only in the second shield section C2 that forms the peripheral region of the beam pattern and may not be provided in the first shield section C1. More preferably, one minute protrusion 232*c* may be formed in each of the plurality of unit shields 232 provided in the second shield section C2.

Here, since the protrusion areas 232*a*, the recess areas 232*b*, and the minute protrusions 232*c* may be provided on the upper periphery of the shield 230 as described above, the upper periphery of the shield 230 may have an uneven structure. However, as illustrated in FIGS. 5 and 6, the lower periphery of the shield 230 may have a flat shape unlike the upper periphery.

Also, referring to FIG. 6, a ratio x/y of a width x of the minute protrusion 232*c* to a width y of the protrusion area 232*a* including the minute protrusion 232*c* among the plurality of protrusion areas 232*a* may be about 0.1 to about 0.3. When x/y is greater than about 0.3, the brightness of the beam pattern may be excessively reduced. On the other hand, when x/y is less than about 0.1, the regulations required for the 50L area in the beam pattern may not be satisfied.

Here, as described above, the MLA module 200 may include the entrance lens array 210 and the exit lens array 220, and the entrance lens array 210 and the exit lens array 220 may include the plurality of entrance lenses 212 and the plurality of exit lenses 222, respectively. Also, an optical axis may be formed in each of the plurality of entrance lenses 212 and the plurality of exit lenses 222. In FIGS. 3 and 4, some of optical axes formed in the plurality of entrance lenses 212 and the plurality of exit lenses 222 are indicated by arrows pointing downward.

Here, according to the present disclosure, at least some of optical axes of the plurality of entrance lenses 212 provided in the first entrance section A1 may be aligned with respective ones of optical axes of the plurality of exit lenses 222 provided in the first exit section B1. On the other hand, at least some of optical axes of the plurality of entrance lenses 212 provided in the second entrance area A2 may be misaligned with all of the optical axes of the plurality of exit lenses 222 provided in the second exit area B2.

More preferably, according to the present disclosure, each of all of the optical axes of the plurality of entrance lenses 212 provided in the first entrance area A1 may be aligned with a respective one of the optical axes of the plurality of exit lenses 222 provided in the first exit area B1. Also, all of the optical axes of the plurality of entrance lenses 212 provided in the second entrance area A2 may be misaligned with all of the optical axes of the plurality of exit lenses 222 provided in the second exit area B2. For example, as illustrated in FIG. 3, all of the optical axes of the plurality of entrance lenses 212 provided in the second entrance area A2 are misaligned, in the horizontal direction H, with all of the optical axes of the plurality of exit lenses 222 provided in the second exit area B2.

As described above, the beam pattern formed outside by the lamp may be divided into the central region and the peripheral region. Particularly, in a case in which the lamp is configured to form a low beam pattern of an automobile, the central region of the beam pattern is required to have a high luminous intensity, and the peripheral region of the beam pattern has a low luminous intensity but is required to cover a wide range in the horizontal direction.

Thus, according to the present disclosure, the optical axes of the entrance lenses 212 of the first entrance section A1 formed on the central area of the entrance lens array in the horizontal direction H are respectively aligned with the optical axes of the exit lenses 222 of the first exit section B1 formed on the central area of the exit lens array in the horizontal direction H, and thus, the light may arrive at the outside without diffusion in the horizontal direction H. Thus, the high luminous intensity may be secured in the central region of the beam pattern formed by the lamp according to the present disclosure.

On the other hand, according to the present disclosure, the optical axes of the entrance lenses of the second entrance sections formed on the left area and the right area of the entrance lens array in the horizontal direction are respectively misaligned, in the horizontal direction, with the optical axes of the exit lenses of the second exit sections formed on the left area and the right area of the exit lens array in the horizontal direction, and thus, the light, which has been emitted from the second entrance sections and incident on the second exit sections, may be diffused in the horizontal direction while emitted. Thus, the horizontal peripheral region of the beam pattern formed by the lamp according to the present disclosure may have the low luminous intensity but cover the wide range in the horizontal direction.

Particularly, the micro lens array according to the related art may not be used in a head lamp (for example, a lamp for a low beam) of an automobile because a width of the beam pattern in the horizontal direction is small. However, on the other hand, the lamp including the MLA module according to the present disclosure may be used as the head lamp of an automobile because a width of the beam pattern in the horizontal direction formed by the lamp is large.

Here, according to the present disclosure, some of the optical axes of the plurality of entrance lenses 212 provided in the entrance lens array 210 may be disposed at the same heights in a vertical direction V as the respective ones of the optical axes of the plurality of exit lenses 222 provided in the exit lens array 220. More preferably, as illustrated in FIG. 4, all of the optical axes of the plurality of entrance lenses 212 provided in the entrance lens array 210 may be disposed at the same heights in the vertical direction V as the respective ones of the optical axes of the plurality of exit lenses 222 provided in the exit lens array 220.

As described above, in the beam pattern formed by the lamp according to the present disclosure, the width in the horizontal direction may be large. On the other hand, the width of the beam pattern in the vertical direction may be relatively small. Particularly, the lamp according to the present disclosure may be a lamp for a low beam, and in this case, the width of the low beam pattern in the vertical direction may need to be relatively small.

Thus, in a case in which the heights of the optical axes of the plurality of entrance lenses 212 in the vertical direction may be the same as the heights of the optical axes of the plurality of exit lenses 222 in the vertical direction as described above, the light, which is emitted to the outside after passing through both the entrance lens array and the exit lens array, is less diffused in the vertical direction. Accordingly, the width of the beam pattern in the vertical direction may also be small.

Here, according to the present disclosure, the width of each of the plurality of exit lenses 222 in the horizontal direction H, which are provided in the second exit section B2, may be less than the width of each of the plurality of exit lenses 222 in the horizontal direction H, which are provided in the first exit section B1. For example, the width of each of the plurality of exit lenses 222 in the horizontal direction H, which are provided in the second exit section B2 may be less, by about 10%, than the width of each of the plurality of exit lenses 222 in the horizontal direction H, which are provided in the first exit section B1.

On the other hand, according to the present disclosure, the width of each of the plurality of entrance lenses 212 in the horizontal direction H, which are provided in the first entrance area A1, may be equal to the width of each of the plurality of entrance lenses 212 in the horizontal direction H, which are provided in the second entrance area A2. Also, the width of each of the plurality of entrance lenses 212 in the horizontal direction H, which are provided in the first entrance section A1, may be equal to the width of each of the plurality of exit lenses 222 in the horizontal direction H, which are provided in the first exit section B1.

As described above, this may be to ensure that all of the optical axes of the plurality of entrance lenses 212 provided in the second entrance section A2 are misaligned, in the horizontal direction H, with all of the optical axes of the plurality of exit lenses 222 provided in the second exit section B2. That is, according to the present disclosure, the width of each of the entrance lenses in the horizontal direction H which are provided in the first entrance section A1 is made to be equal to the width of each of the exit lenses in the horizontal direction H which are in the first exit section B1, and thus, the optical axes of the entrance lenses in the first entrance section A1 may be respectively aligned with the optical axes of the exit lenses in the first exit section B1. On the other hand, the width of each of the entrance lenses in the horizontal direction H which are provided in the second entrance section A2 is made to be different from the width of each of the exit lenses in the horizontal direction H which are in the second exit section B2, and thus, the optical axes of the entrance lenses in the second entrance section A2 may be respectively misaligned with the optical axes of the exit lenses in the second exit section B2.

Continuing to refer to the drawings, the widths of the plurality of entrance lenses 212 in the vertical direction V, which are provided in the entrance lens array 210, may be equal to each other. Also, the widths of the plurality of exit lenses 222 in the vertical direction V, which are provided in the exit lens array 220, may also be equal to each other. Here, the width of the entrance lens 212 in the vertical direction V may be equal to the width of the exit lens 222 in the vertical direction V. As described above, this may be to ensure that all of the optical axes of the plurality of entrance lenses 212 are disposed at the same heights in the vertical direction as the respective ones of the optical axes of the plurality of exit lenses 222.

Here, according to the present disclosure, the radius of curvature of each of the plurality of entrance lenses 212 in the horizontal direction H, which are provided in the first entrance section A1, may be different from the radius of curvature of each of the plurality of entrance lenses 212 in the horizontal direction H, which are provided in the second entrance section A2. For one example, the radius of curvature of each of the plurality of entrance lenses 212 in the horizontal direction H, which are provided in the first entrance section A1, may be greater than the radius of curvature of each of the plurality of entrance lenses 212 in the horizontal direction H, which are provided in the second entrance section A2. That is, the curvature of each of the plurality of entrance lenses 212 in the horizontal direction H, which are provided in the second entrance section A2, may be greater than the curvature of each of the plurality of entrance lenses 212 in the horizontal direction H, which are provided in the first entrance section A1. This may be to ensure that the horizontal width of the peripheral region of the beam pattern formed by the lamp according to the present disclosure becomes large.

On the other hand, according to the present disclosure, the radius of curvature of each of the plurality of exit lenses 222 provided in the first exit section B1 may be equal to the radius of curvature of each of the plurality of exit lenses 222 provided in the second exit section B2.

Automobile

An automobile according to the present disclosure may include a lamp 10 for an automobile (hereinafter, referred to as a 'lamp').

Here, the lamp 10 may include: a light source 100 which generates and emits light; a MLA module 200 which is provided in front of the light source 100 and on which the light is incident; and a collimator 300 provided between the light source 100 and the MLA module 200.

Also, the MLA module 200 may include: an entrance lens array 210 which includes a plurality of entrance lenses 212 and on which the light is incident; an exit lens array 220 which is provided in front of the entrance lens array 210 and includes a plurality of exit lenses 222, and which receives the light incident on the entrance lens array 210 and emits the light to the outside; a shield 230 provided between the entrance lens array 210 and the exit lens array 220; an entrance body 240 which is provided between the entrance lens array 210 and the shield 230 and supports the entrance lens array 210; and an exit body 250 which is provided between the exit lens array 220 and the shield 230 and supports the exit lens array 220.

Here, the entrance lens array 210 may include a first entrance section A1 and a second entrance section A2. Also, the exit lens array 220 may include a first exit section B1 and a second exit section B2. Also, the light, which has been incident on the first entrance section A1, may be emitted from the first section A1 and then incident on the first exit section B1. Also, the light, which has been incident into the second entrance section A2, may be emitted from the second entrance section A2 and then incident into the second exit section B2.

In addition, the shield 230 may include a plurality of unit shields 232, each of which includes a protrusion area 232*a* protruding upward from an upper periphery of the shield 230 and a recess area 232*b* recessed downward from the protrusion area 232*a*. Also, the plurality of unit shields 232 may be arranged in a horizontal direction.

Here, minute protrusions 232*c* each having a shape lifted upward may be provided in some of the plurality of protrusion areas 232*a* or the plurality of recess areas 232*b*. More preferably, the minute protrusions 232*c* may be formed in some of the plurality of protrusion areas 232*a*.

According to the present disclosure, the various types of lamps for an automobile may be manufactured by using the micro lens array, and the beam patterns formed by these lamps may satisfy the regulations.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for an automobile, the lamp comprising:

a light source configured to generate and emit light; and a micro lens array (MLA) module which is provided in front of the light source and on which the light is incident, wherein the MLA module comprises:

an entrance lens array which comprises a plurality of entrance lenses and on which the light is incident;

an exit lens array which is provided in front of the entrance lens array and comprises a plurality of exit lenses, and which receives the light incident on the entrance lens array and emits the light outside, thereby forming a beam pattern on the outside; and a shield provided between the entrance lens array and the exit lens array, wherein the entrance lens array comprises a first entrance section and a second entrance section and the exit lens array comprises a first exit section and a second exit section, and further wherein at least some of optical axes of the plurality of entrance lenses provided in the first entrance section are aligned with respective ones of optical axes of the plurality of exit lenses provided in the first exit section, at least some of optical axes of the plurality of entrance lenses provided in the second entrance section are misaligned with all of the optical axes of the plurality of exit lenses provided in the second exit section, wherein the shield further comprises a plurality of unit shields forming an upper periphery of the shield, wherein each of the plurality of unit shields comprises a protrusion segment protruding upward and a recess segment recessed downward from the protrusion segment, wherein the plurality of unit shields are arranged in a horizontal direction, and minute protrusions each having a shape lifted upward are provided in some of the plurality of protrusion segments or the plurality of recess segments.

2. The lamp of claim 1, wherein the shield comprises a first shield section and a second shield section, wherein the first shield section is provided in a central region of the shield in the horizontal direction, and the second shield section is provided on a left side or a right side of the first shield section, wherein the minute protrusions are provided in the second shield section.

3. The lamp of claim 1, wherein the minute protrusions are formed in some of the plurality of protrusion segments.

4. The lamp of claim 1, wherein a lower periphery of the shield has a flat shape.

5. The lamp of claim 3, wherein a ratio of a width of the minute protrusion to a width of the protrusion segment comprising the minute protrusion among the plurality of protrusion segments is about 0.1 to about 0.3.

6. The lamp of claim 2, wherein the first shield section is provided facing the first entrance section and the first exit section, and the second shield section is provided facing the second entrance section and the second exit section.

7. The lamp of claim 1, wherein each of the plurality of unit shields is provided corresponding to one of the plurality of exit lenses provided in the exit lens array.

8. The lamp of claim 2, wherein the minute protrusion is formed in each of the plurality of unit shields provided in the second shield section.

9. The lamp of claim 2, wherein the minute protrusion is not provided in the first shield section.

10. The lamp of claim 1, wherein each of all of the optical axes of the plurality of entrance lenses provided in the first entrance section is aligned with a respective one of the optical axes of the plurality of exit lenses provided in the first exit section, and all of the optical axes of the plurality of entrance lenses provided in the second entrance section are misaligned with all of the optical axes of the plurality of exit lenses provided in the second exit section.

11. The lamp of claim 1, wherein all of the optical axes of the plurality of entrance lenses provided in the second entrance section are misaligned, in the horizontal direction, with all of the optical axes of the plurality of exit lenses provided in the second exit section.

12. The lamp of claim 1, wherein all of the optical axes of the plurality of entrance lenses provided in the entrance lens array are disposed at same heights in a vertical direction as the respective ones of the optical axes of the plurality of exit lenses provided in the exit lens array.

13. The lamp of claim 1, wherein widths of the plurality of entrance lenses in a vertical direction, which are provided in the entrance lens array, are equal to each other.

14. The lamp of claim 1, wherein widths of the plurality of exit lenses in a vertical direction, which are provided in the exit lens array, are equal to each other.

15. The lamp of claim 1, wherein a width of each of the plurality of entrance lenses in the horizontal direction, which are provided in the first entrance section, is equal to a width of each of the plurality of entrance lenses in the horizontal direction, which are provided in the second entrance section.

16. The lamp of claim 1, wherein a width of each of the plurality of exit lenses in the horizontal direction, which are provided in the second exit section, is less than a width of each of the plurality of exit lenses in the horizontal direction, which are provided in the first exit section.

17. An automobile comprising a lamp for an automobile, wherein the lamp comprises:

a light source configured to generate and emit light; and a micro lens array (MLA) module which is provided in front of the light source and on which the light is incident, wherein the MLA module comprises:

an entrance lens array which comprises a plurality of entrance lenses and on which the light is incident;

an exit lens array which is provided in front of the entrance lens array and comprises a plurality of exit lenses, and which receives the light incident on the entrance lens array and emits the light outside, thereby forming a beam pattern on the outside; and a shield provided between the entrance lens array and the exit lens array, wherein the entrance lens array comprises a first entrance section and a second entrance section and the exit lens array comprises a first exit section and a second exit section, and further wherein at least some of optical axes of the plurality of entrance lenses provided in the first entrance section are aligned with respective ones of optical axes of the plurality of exit lenses provided in the first exit section, at least some of optical axes of the plurality of entrance lenses provided in the second entrance section are misaligned with all of the optical axes of the plurality of exit lenses provided in the second exit section, wherein the shield further comprises a plurality of unit shields, wherein each of the plurality of unit shields comprises a protrusion segment protruding upward from an upper periphery of the shield and a recess segment recessed downward from the protrusion segment, wherein the plurality of unit shields are arranged in a horizontal direction, and minute protrusion each having a shape lifted upward is provided in some of the plurality of protrusion segments or the plurality of recess segments.

* * * * *